US005374363A

United States Patent [19]

Fukuda et al.

[11] Patent Number: 5,374,363

[45] Date of Patent: Dec. 20, 1994

[54] VISCOUS COUPLING FLUIDS

[75] Inventors: Masahiko Fukuda; Teiji Masuda, both of Tochigi; Kenichi Sekine, Saitama; Manabu Tohyama, Kanagawa; Norio Yano, Chiba; Yukio Yuhashi, Saitama, all of Japan

[73] Assignees: Dow Corning Asia, Ltd.; Vicodrive Japan, Ltd.; Cosmo Oil Co, Ltd., all of Tokyo, Japan

[21] Appl. No.: 153,720

[22] Filed: Nov. 17, 1993

[30] Foreign Application Priority Data

Nov. 20, 1992 [JP] Japan ..... 4-312189

[51] Int. Cl.[5] ..... C10M 105/76

[52] U.S. Cl. ..... 252/32.7 E; 252/33.6; 252/45; 252/49.6; 252/78.3

[58] Field of Search ..... 252/32.7 E, 33.6, 45, 252/49.6, 78.3

[56] References Cited

U.S. PATENT DOCUMENTS

| | | | |
|---|---|---|---|
| 3,317,428 | 5/1967 | Pater | 252/75 |
| 4,051,053 | 9/1977 | Elliott et al. | 252/78.3 |
| 4,097,393 | 6/1978 | Cupper et al. | 252/78.3 |
| 4,244,831 | 1/1981 | Cupper | 252/78.3 |
| 4,683,319 | 7/1987 | Yoshitake et al. | 556/425 |
| 4,840,743 | 6/1989 | Gardiner | 252/49.6 |
| 4,840,743 | 6/1989 | Gardiner | 252/49.6 |
| 4,959,166 | 9/1990 | Minamitani et al. | 252/327 |

FOREIGN PATENT DOCUMENTS 2719038 11/1978 Germany .

*Primary Examiner*—Jacqueline V. Howard
*Attorney, Agent, or Firm*—Robert Spector

[57] ABSTRACT

The shortcomings inherent in prior art coupling fluids are eliminated by combining 1) a polyorganosiloxane fluid as the base oil with 2) sulfur or certain sulfur compounds and 3) at least one cyclic organosiloxane. These three ingredients form a suitable coupling fluid for use in viscous coupling systems.

3 Claims, No Drawings

VISCOUS COUPLING FLUIDS

BACKGROUND OF THE INVENTION

1. Field of the Invention

This invention relates to viscous coupling fluids. More particularly, this invention relates to stable viscous coupling fluids containing combinations of polyorganosiloxanes with sulfur or with specified classes of sulfur containing organic compounds. These fluids are stable, as evidenced by the low degree of viscosity change and the absence of gelation during long periods of use.

2. Background Information

Axle joints that utilize the principles of viscous coupling have long been employed in differential mechanisms and drive shafts of four wheel drive vehicles because of the way viscous coupling improves driving stability and shock absorption on bad roads. Durability of viscous coupling is highly dependent on property of viscous coupling fluid.

Typical structures in which drive mechanisms employing viscous coupling are used consist of a housing and hub. The hub and the housing side will have a number of thin circular metal plates attached to it and will contain the highly viscous coupling fluid. A rotational differential is located between the hub and the plates on the housing side, and either torque is transferred or the rotational differential is controlled. Structures containing viscous coupling fluids are described in Japanese Laid-Open Patent Publication SHO 58-48779.

The viscous coupling is utilized for viscous resistance of viscous coupling fluids. In the case of automobiles, it is important that, so far as it is possible, a small device develops the required torque. This requirement results in the use of fluids of comparatively high viscosity. Additionally, the fluid used in viscous coupling should show little change in viscosity in relation to changes in temperature. Stability at high temperatures is important. Previously used silicone oils are typically dimethyl polyorganosiloxanes, which have a viscosity at 25° C. of from 5,000–500,000 cSt.

The high temperatures produced by the shear force and the friction between the plates will often, over a period of time, finally cause the viscosity of the coupling fluid to rise until the fluid finally gels. This constitutes a problem in the use of the fluid. When the viscosity of the coupling fluid rises considerably and gels, the initial performance expectations for which the viscous coupling system was designed can no longer be met. A solution was sought for this problem.

On the other hand, when the coupling fluid is at a comparatively high temperature, heat decomposition causes a lowering of the viscosity with the result that once again the initial performance expectations for which the viscous coupling system was designed can no longer be met.

Various kinds of heat resistance additives for organopolysiloxane have been studied. The use of sulfur compounds for this purpose is described in U.S. Pat. No. 4,959,166 and the use of phosphorus compounds in Japanese patent publication Hei 2-91196.

However, the use sulfur or phosphorous compounds as additives does not have the desired effect. The present inventors observed good resistance to a substantial rise in viscosity and eventual gel formation due to polymerization or crosslinking using these additives, but the decrease in viscosity due to heat-induced decomposition cannot be prevented.

One objective of this invention is to provide a thermally stable fluid for use in viscous coupling systems. During use the viscosity of the present fluids neither increases, resulting ultimately in gel formation, nor decreases due to heat-induced decomposition.

SUMMARY OF THE INVENTION

The present inventors discovered that the defects inherent in prior art coupling fluids are eliminated by the combination of 1) a polyorganosiloxane fluid as the base oil with 2) at least one member selected from the group consisting of sulfur or certain sulfur compounds and 3) at least one cyclic organosiloxane. These three ingredients form a suitable coupling fluid for use in viscous coupling systems.

DETAILED DESCRIPTION OF THE INVENTION

This invention provides a viscous coupling fluid comprising (A) a polyorganosiloxane having a linear or branched chain structure, a viscosity of from 100 to 500,000 cSt at 25° C. and exhibiting the average unit formula $$(R^1)_aSiO_{(4-a)/2},$$

where $R^1$ represents a hydrocarbon or halogen-substituted hydrocarbon radical and the value of a is from 1.9 to 2.1;

(B) sulfur or a sulfur-containing compound selected from the group consisting of 1) sulfur-containing organic compounds of the formula $$R^2—S_X—(R^3—S_X)_n—R^2,$$

2) reaction products of fats and sulfur, 3) zinc salts of dithiophosphoric acids of the formula

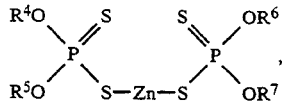

4) metal salts of dialkyl dithiocarbamic acids of the formula

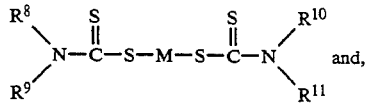

and, 5) sulfur-containing organic compounds of the formula $$\boxed{R^{12}—S_x—(R^{13}—S_x)_m}$$

where $R^2$, $R^4$, $R^5$, $R^6$, $R^7$, $R^8$, $R^9$, $R^{10}$, and $R^{11}$ represent identical or different hydrocarbon radicals, $R^3$, $R^{12}$ and $R^{13}$ represent identical or different divalent hydrocarbon radicals, M is a metal selected from the group consisting of zinc, lead, molybdenum and antimony, m and n are each 0 or an integer of 1 or more, each x is individually selected from integers greater than 0, Me is zinc, lead, molybdenum, or antimony, and (C) cyclic siloxanes of the formula

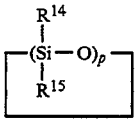

where $R^{14}$ is a phenyl radical and $R^{15}$ represents a methyl or a phenyl radical; and p represents a number from 3 to 25, inclusive.

The Polyorganosiloxane (Ingredient A)

The primary ingredient of the present compositions is a polyorganosiloxane containing repeating units of the average formula (1)

$$R^1_aSiO_{(4-a)/2}.$$

In this formula $R^1$ represents a monovalent hydrocarbon or halogenated hydrocarbon radical. This radical can be linear or branched alkyl or alkene and contains from 1 to 12 carbon atoms, or an aromatic hydrocarbon radicals containing from 6 to 18 carbon atoms. Alternatively, one or more hydrogen atoms of $R^1$ can be replaced with halogen atoms such as fluorine, chlorine, bromine and iodine. Preferred alkyl and halogenated aliphatic hydrocarbon radicals contain from 1 to 8 carbons, and include but are not limited to methyl, ethyl, butyl, hexyl, octyl, trifluoropropyl, and octenyl radicals. The hydrocarbon radicals bonded to any one silicon atom can be identical or different.

The molecules of polyorganosiloxane are typically linear, but can optionally contain some branching. In linear high molecular weight molecules the value of a will approach 2.0; if the molecular weight is low, a will exceed 2.0. If a branched portion is included a will be lower than 2.0.

Examples of polyorganosiloxanes that can be used as ingredient A include but are not limited to polydimethylsiloxanes, dimethylsiloxane/methylphenylsiloxane copolymers, dimethyl/diphenylsiloxane copolymers, polymethylhexylsiloxanes, polymethyloctylsiloxanes, polymethyl-3,3,3-trifluoropropylsiloxanes, and dimethylsiloxane/methyl-3,3,3-trifluoropropylsiloxane. Ingredient A can comprise a mixture of two or more polyorganosiloxanes.

The terminal units of ingredient A are preferably triorganosilyl group such as trimethylsilyl.

The viscosity of ingredient A, measured at 25 ° C., is typically from about 100 to 500,000 cSt, equivalent 0.1 to $500\times10^{-3}$ $m^2$/second, with from 5,000 to 400,000 cSt being preferred. If the viscosity is too low, the viscous resistance of the final fluid is small and the amount of viscous coupling needed must be very high. If the viscosity of ingredient A is too high, resulting in too much viscous resistance, a great deal of heat is produced and longevity of the polyorganosiloxane is reduced.

Ingredient A is the base oil of the present compositions, and typically constitutes from 90 to 99.99 percent of the total weight of the composition, most preferably from 95 to 99.95 weight percent.

The present viscous coupling fluids contain small amounts of specified sulfur-containing materials, referred to hereinafter as ingredient B, and at least one cyclic organosiloxane, referred to hereinafter as ingredient C, as additives.

The Sulfur-Containing Additive (Ingredient B)

One class of sulfur compounds are represented by formula B1

$$R^2—S_X—(R^3—S_X)_n—R^2. \qquad \text{B1}$$

In this formula $R^2$ represents a monovalent hydrocarbon radical. When $R^2$ represents an aliphatic hydrocarbon radical it can be linear or branched, saturated or unsaturated and contains from 2 to 20 carbons. Alternatively, $R^2$ can be an aromatic hydrocarbon radical containing from 6 to 26 carbon atoms. Specific examples of suitable hydrocarbon radicals include but are not limited to ethyl, propyl, butyl, nonyl, dodecyl, propenyl, butenyl, benzyl, phenyl, tolyl, and hexylphenyl groups. $R^3$ represents a divalent hydrocarbon radical that can be a linear or branched chain containing from 2 to 20 aliphatic carbon atoms or $R^3$can be an aromatic radical containing from 6 to 26 carbon atoms. Specific examples of $R^3$ include ethylene, propylene, butylene, and phenylene.

The classes of sulfur compounds represented by formula B1 are olefin sulfide and polysulfide compounds represented by the formula $R^2$—Sx—$R^2$, where x is 2 or more.

Specific compounds represented by formula B1 include but are not limited to diisobutyl disulfides, dioctyl polysulfide, di-tertiary nonyl polysulfide, di-tertiary butyl polysulfide, dibenzyl polysulfide, and polyisobutylene sulfides represented by the formula $$CH_2{=}C(CH_3)CH_2—S_X—'CH_2C(CH_3)_2—S_X—'_2CH_2C(CH_3){=}CH_2$$

In this formula x and n have the same definitions as in formula B1.

The sulfated oil identified as species B2 of ingredient B of the present compositions is the product of a reaction between a fat and sulfur. The fat is an oil of plant or animal origin such as lard, tallow, whale oil, palm oil, coconut oil, or rapeseed oil. The chemical structure of the reaction products is complex, and the chemical structure of this ingredient is not clear.

Zinc salts of dithiophosphoric acid are represented by formula B3

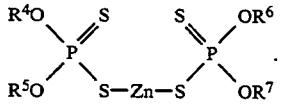

In formula B3, $R^4$, $R^5$, $R^6$, and $R^7$ are identical or different monovalent hydrocarbon radicals. These hydrocarbon radicals contain from 3 to 20, preferably from 3 to 12 carbon atoms in the form of linear or branched alkyl or alkenyl radicals or aromatic hydrocarbon radicals containing from 6 to 20 carbon atoms. Specific examples of these hydrocarbon radicals include but are not limited to propyl, butyl, nonyl, dodecyl, octenyl, phenyl, and tolyl groups.

Specific embodiments of compounds represented by formula B3 are zinc salts of diisobutyl dithiophosphoric acid, dipentyl dithiophosphoric acid, di-1-methyl heptyl dithiophosphoric acid, di-2-ethylhexyl dithiophosphoric acid, and diphenyl dithiophosphoric acid.

In the metal salts of dialkyl thiocarbamates represented by formula B4, $R^8$, $R^9$, $R^{10}$, and $R^{11}$ are identical or different monovalent hydrocarbon radicals. Examples of these radicals are linear aliphatic radicals containing from 3 to 20, preferably from 3 to 12, carbon atoms. Specific radicals include propyl, butyl, nonyl, and dodecyl. The metal represented by M in the formula B4 is Zn, Pb, Mo, or Sb

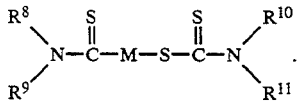

Specific compounds represented by formula B4 include but are not limited to metal salts of diisobutyl thiocarbamine phosphoric acid, diamyl thiocarbamine phosphoric acid, and didodecyl thiocarbamine phosphoric acid.

The elemental sulfur identified as species B5 of ingredient B is powdered sulfur that is blended with the polyorganosiloxane referred to as ingredient A of the present compositions. The mixture is stirred while the temperature is raised to approximately 150°–250 ° C., thereby dissolving or dispersing the sulfur.

When ingredient B is a cyclic sulfide, it can be represented by formula B6

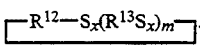

The substituents identified as $R^{12}$ and $R^{13}$ in formula B6 are divalent hydrocarbon radicals. Examples of suitable radicals include those with linear and branched aliphatic hydrocarbon radicals containing from 2 to 20 carbon atoms, and aromatic hydrocarbon radicals containing from 6 to 26 carbon atoms. Specific examples of these divalent hydrocarbon radicals include ethylene, propylene, butylene, and phenylene. A specific example of a sulfur compound of this type is one in which $R^{12}$ and $R^{13}$ of formula B6 are isobutylene and m is 3. This cyclic sulfide compound can be prepared as described in U.S. Pat. No. 3,925,414 by the reaction of an olefin such as isobutylene and a sulfur monohalide is reacted with a alkali mercaptide.

The linear sulfide compound represented by formula B1 constitutes from about 0.01 to about 10% of the total weight of the viscous coupling fluid, preferably from 0.1 to 5 weight percent.

If the concentration of ingredient B1 in the final viscous coupling composition is too low, the beneficial effects will be too small. If too much of this ingredient is present, the composition will be susceptible to damage by heat, resulting in large undesirable effects. The same is true for the embodiments of ingredient B identified as B2, B3, B4, B5 and B6.

When ingredient B is sulfur, this ingredient is particularly effective when it constitutes from about 0.01 to about 5.0 weight percent, preferably from 0.05 to 2.0 weight percent, of the total volume of the final viscous coupling composition.

The present compositions are desirably prepared by dissolving ingredient B in the polyorganosiloxane base oil, however solubilization is not required. Dispersing ingredient B in the base oil is also satisfactory, as the viscosity of the base oil is high, and the extent of reaction of ingredient B with the base oil is also acceptable.

Each of the ingredients B1, B2, B3, B4, B5 and B6 that can be added to ingredient A has an independent effect. Combinations containing from two to all six of these ingredients can be used. When more than one of these ingredients is used, the total weight of ingredient B should constitute from 0.01 to 10 percent of the total weight of the composition.

Unless otherwise indicated, the concentrations of all ingredients of the present composition are expressed as weight percents, and are based on the total weight of the composition.

Ingredient C, a cyclic organosiloxane, is used to prevent a decrease in viscosity of the present compositions resulting from heat-induced decomposition. These cyclic siloxane can contain an average of from 3 to 25, preferably from 3 to 20 siloxane units per molecule.

Ingredient C constitutes from 0.1 to 5 percent, preferably from 0.5 to 2 percent, of the total weight of the present compositions. If less than 0. 1 weight of ingredient C is present, the ingredient will not provide enough protection against heat-induced lowering of viscosity. There is very little increase in beneficial effects if the concentration of ingredient C exceeds more than 5 weight percent, so using too much is not desirable.

The use of zirconium siloxane, also referred to hereinafter as ingredient D, as in ingredient of the present compositions in combination with ingredients A, B, and C contributes to protection against a heat-induced reduction of viscosity of the composition during use. When a zirconium siloxane is present, each of the zirconium atoms combines with at least one siloxy group to form a compound. The average formula of the resultant product can be expressed by formula D

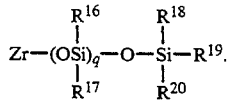

In formula D $R^{16}$ and $R^{17}$ represent alkyl or allyl radicals; $R^{18}$, $R^{19}$, and $R^{20}$ and are ZrO, $R^{21}$, OH or $OR^{21}$, where $R^{21}$ represents an alkyl or allyl radical, and the value of q is from 0 to 50, inclusive.

Examples of suitable zirconium siloxanes are represented by formulae D1, D2 and D3

$$ZR'OSi(CH_3)_3'_4 \qquad D1$$

$$(C_4H_9O)_2Zr'OSi(C_4H_9)_2OH'_2 \qquad D2$$

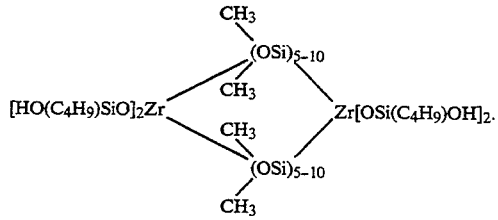

The zirconium siloxanes, for example, can be prepared by reacting a zirconium alkoxide with an organopolysiloxane containing terminal silanol groups. Any zirconium compound that does not participate in this reaction can be subsequently reacted with compounds containing alkoxy groups or halogen atoms.

The zirconium siloxane should constitute from 0.1 to 5 percent, preferably from 0.5 to 2 percent, of the total weight of the composition. If it forms less than 0.1 percent of the total weight, its effectiveness in preventing a heat-induced reduction in viscosity will be insufficient. There is very little increase in beneficial effects using more than 5% of the zirconium siloxane, so using too much is not desirable.

Any of the known heat stabilizers can be used in the present compositions, in addition to additives that will impart other desirable properties. In particular, when the use of a viscous coupling fluid under a variety of severe conditions is considered, previously known additives that increase the ability to withstand heat are desirable. One of these additives is the phosphide and chloride compound covered by Japanese patent publication no. 2-91196. Other useful additives prevent oxidation, rust, or function as metal deactivators.

While the ingredients described in this specification are typically used as viscous coupling fluids, they can also be used in other fluid coupling applications such as fan coupling.

The present viscous coupling fluid compositions can be used for extended periods without undergoing an increase in viscosity, gelation, or a decreases in viscosity due to heat-induced decomposition. The compositions are therefore considered to be thermally stable. In addition to this advantage, use of the present compositions as fluids in viscous coupling systems has a beneficial effect on wear resistance of plate, contributing to the longevity of the viscous coupling system and increasing the reliability of the automobile.

The following examples described preferred viscous coupling compositions and the properties of these compositions. The examples should not be interpreted as limiting the scope of the present invention as described in the accompanying claims. Unless indicated otherwise, all parts and percentages are by weight and viscosities were measured at 25°

EXPERIMENTS 1-8

The viscous coupling fluids were tested under typical operating conditions, and their stability under heating conditions were evaluated. The results are presented in Table 2.

The ingredients listed in Table 1 were combined and stirred for one hour while being heated at a temperature of 60 ° C. The polydimethylsiloxane used in experiments 1-8 and comparison examples 1-7 was completely linear and contained trimethylsiloxy units as the only terminal units.

The di-tertiary nonyl polysulfide used in experiments 1 and 2 and comparisons 1 and 2 had a specific gravity (at 15° C./4° C.) of 1.045 and contained 37.5 weight percent sulfur. It was obtained from Nihon Thiochemical K.K. as "TNPS"

The sulfated olefin in experiments 3-8 and comparison examples 3-7 had a specific gravity (at 15° C./4° C.) of 1.14, contained 46.5 weight percent sulfur and exhibited a viscosity of 9.0 cSt ($9\times10^{-6}$ m$^2$/sec) at 100° C. This ingredient was obtained from Nihon Cooper K.K as "HITEC 053". The zirconium siloxane used in experiments 2-8 and comparisons 2-7 had a specific gravity at 25° C. of 0.993, a viscosity of 25 cSt ($25\times10^{-6}$ m$^2$/sec), and contained 3.0 weight percent of zirconium.

The siloxane containing an aromatic amine group that was used in experiment 4 had a specific gravity (at 25° C.) of 1.080 and a viscosity of 115 cSt ($0.115\times10^{-3}$ m$^2$/sec.

TABLE 1

| Ingredient | Weight Percent |
|---|---|
| Experiment 1 | |
| polydimethylsiloxane ($300 \times 10^{-3}$ m$^2$/sec) | 98.5 |
| di-tertiary nonylpolysulfide | 1.0 |
| $[(C_6H_5)(CH_3)SiO)]_3$ | 0.5 |
| Experiment 2 | |
| polydimethylsiloxane ($300 \times 10^{-3}$ m$^2$/sec) | 98.0 |
| di-tertiary nonylpolysulfide | 1.0 |
| $[(C_6H_5)(CH_3)SiO)]_3$ | 0.5 |
| zirconium siloxane | 0.5 |
| Experiment 3 | |
| polydimethylsiloxane ($300 \times 10^{-3}$ m$^2$/sec) | 96.3 |
| sulfated olefin | 2.0 |
| $[(C_6H_5)(CH_3)SiO)]_4$ | 1.0 |
| zirconium siloxane | 0.5 |
| Experiment 4 | |
| polydimethylsiloxane ($300 \times 10^{-3}$ m$^2$/sec) | 97.5 |
| sulfated olefin | 1.0 |
| zirconium siloxane | 0.5 |
| $[(C_6H_5)(CH_3)SiO)]_4$ | 0.5 |
| siloxane with an aromatic amine group | 0.5 |
| Experiment 5 | |
| polydimethylsiloxane ($100 \times 10^{-3}$ m$^2$/sec) | 98.0 |
| sulfated olefin | 1.0 |
| zirconium siloxane | 0.5 |
| $[(C_6H_5)(CH_3)SiO)]_4$ | 0.5 |
| Experiment 6 | |
| polydimethylsiloxane ($50 \times 10^{-3}$ m$^2$/sec) | 98.0 |
| sulfated olefin | 1.0 |
| zirconium siloxane | 0.5 |
| $[(C_6H_5)(CH_3)SiO)]_4$ | 0.5 |
| Experiment 7 | |
| polydimethylsiloxane ($20 \times 10^{-3}$ m$^2$/sec) | 98.0 |
| sulfated olefin | 1.0 |
| zirconium siloxane | 0.5 |
| $[(C_6H_5)(CH_3)SiO)]_4$ | 0.5 |
| Experiment 8 | |
| polydimethylsiloxane ($5 \times 10^{-3}$ m$^2$/sec) | 98.0 |
| sulfated olefin | 1.0 |
| zirconium siloxane | 0.5 |
| $[(C_6H_5)(CH_3)SiO)]_4$ | 0.5 |
| Comparison Example 1 | |
| polydimethylsiloxane ($300 \times 10^{-3}$ m$^2$/sec) | 99.0 |
| di-tertiary nonylpolysulfide | 1.0 |
| Comparison Example 2 | |
| polydimethylsiloxane ($300 \times 10^{-3}$ m$^2$/sec) | 98.5 |
| di-tertiary nonylpolysulfide | 1.0 |
| zirconium siloxane | 0.5 |
| Comparison Example 3 | |
| polydimethylsiloxane ($300 \times 10^{-3}$ m$^2$/sec) | 97.5 |
| sulfated olefin | 2.0 |
| zirconium siloxane | 0.5 |
| Comparison Example 4 | |
| polydimethylsiloxane ($100 \times 10^{-3}$ m$^2$/sec) | 98.5 |
| sulfated olefin | 1.0 |
| zirconium siloxane | 0.5 |
| Comparison Example 5 | |
| polydimethylsiloxane ($50 \times 10^{-3}$ m$^2$/sec) | 98.5 |
| sulfated olefin | 1.0 |
| zirconium siloxane | 0.5 |
| Comparison Example 6 | |
| polydimethylsiloxane ($20 \times 10^{-3}$ m$^2$/sec) | 98.5 |
| sulfated olefin | 1.0 |
| zirconium siloxane | 0.5 |
| Comparison Example 7 | |
| polydimethylsiloxane ($5 \times 10^{-3}$ m$^2$/sec) | 98.5 |
| sulfated olefin | 1.0 |
| zirconium siloxane | 0.5 |

The compounds described in experiments 1-8 and comparison examples 1-7 were evaluated as fluids for viscous coupling systems. The results are shown in Table 2.

The fluids were evaluated by placing approximately 40 g of the fluid in a 50 cc beaker with an internal diameter of about 3 cm and maintained in a level position in a rotating vessel that was maintained at 180° C. and supplied with air circulation. This temperature was maintained for 120 hours, at which time the viscosity of each sample was measured. The percentage decrease in viscosity that occurred during the heating period of each of the samples was calculated and is recorded in Table 2.

TABLE 2

Stable Temperature Experiment Results, 180° C., 120 hours

| Experiment number | change in viscosity (%) |
|---|---|
| Experiment 1 | −40 |
| Experiment 2 | −12 |
| Experiment 3 | −15 |
| Experiment 4 | −18 |
| Experiment 5 | −12 |
| Experiment 6 | −8 |
| Experiment 7 | −5 |
| Experiment 8 | −2 |
| Comparison 1 | −55 |
| Comparison 2 | −62 |
| Comparison 3 | −65 |
| Comparison 4 | −58 |
| Comparison 5 | −42 |
| Comparison 6 | −26 |
| Comparison 7 | −16 |

That which is claimed is

1. A viscous coupling fluid comprising (A) a polyorganosiloxane having a linear or branched chain structure, a viscosity of from 100 to 500,000 cSt at 25° C. and exhibiting the average unit formula $$(R^1)_aSiO_{(4-a)/2},$$

where $R^1$ represents a hydrocarbon or halogen-substituted hydrocarbon radical and the value of a is from 1.9 to 2.1;

(B) at least one member selected from the group consisting of sulfur and sulfur-containing compounds selected from the group consisting of 1) sulfur-containing organic compounds of the formula $$R^2—S_X—(R^3—S_X)_n—R^2$$

2) reaction products of fats and sulfur, 3) zinc salts of dithiophosphoric acids of the formula

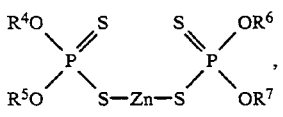

4) metal salts of dialkyl dithiocarbamic acids of the formula

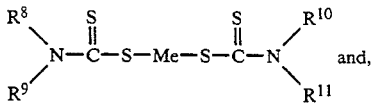

and, 5) sulfur-containing organic compounds of the formula

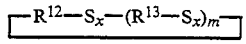

where $R^2$, $R^4$, $R^5$, $R^6$, $R^7$, $R^8$, $R^9$, $R^{10}$, and $R^{11}$ represent identical or different hydrocarbon radicals, $R^3$, $R^{12}$ and $R^{13}$ represent divalent hydrocarbon radicals, m and n are each O or an integer of at least 1, each x is individually selected from integers greater than 0, and Me is zinc, lead, molybdenum, or antimony, and (C) cyclic siloxanes of the formula

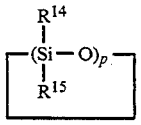

where $R^{14}$ is a phenyl radical and $R^{15}$ represents a methyl or a phenyl radical; and p represents a number from 3 to 25, inclusive.

2. A viscous coupling fluid according to claim 1 where $R^1$ represents an alkyl or alkylene radical containing from 1 to 12 carbon atoms or an aryl radical containing from 6 to 18 carbon atoms; said polyorganosiloxane constitutes from 90 to 99.9 percent of the total weight of said fluid, $R^2$ represents an aliphatic hydrocarbon radical containing from 23 to 20 carbon atoms or an aryl radical containing from 6 to 25 carbon atoms; $R^3$ represents an aliphatic hydrocarbon radical containing from 2 to 20 carbon atoms or an aryl hydrocarbon radical containing from 6 to 26 carbon atoms, $R^4$, $R^5$, $R^6$, and $R^7$ represent an alkyl radical containing from 3 to 12 carbon atoms or an aryl radical containing from 6 to 20 carbon atoms; $R^8$, $R^9$, $R^{10}$ and $R^{11}$ represent a liner aliphatic hydrocarbon radical containing from 3 to 20 carbon atoms; $R^{12}$ and $R^{13}$ represent a linear or branched aliphatic hydrocarbon radical containing from 2 to 20 carbon atoms or an aryl radical containing from 6 to 26 carbon atoms, and said fluid further comprises a zirconium siloxane corresponding to the formula

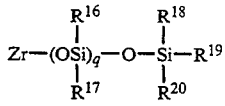

where $R^{16}$ and $R^{17}$ represent alkyl or allyl radicals; $R^{18}$, $R^{19}$, and $R^{20}$ are ZrO, $R^{21}$, OH or $OR^{21}$, where $R^{21}$ represents an alkyl or allyl radical, and the value of q is from 0 to 50, inclusive.

3. A fluid according to claim 2 where said polyorganosiloxane is selected from the group consisting of polydimethylsiloxanes, dimethylsiloxane/methylphenylsiloxane copolymers, dimethyl/diphenylsiloxane copolymers, polymethylhexylsiloxanes, polymethyloctylsiloxanes, polymethyl-3,3,3-trifluoropropylsiloxanes, and dimethylsiloxane/methyl-3,3,3- trifluoropropylsiloxane and said sulfur-containing compounds constitute from 0.1 to 5 weight percent of said fluid.

* * * * *